United States Patent [19]

Burlet

[11] 4,142,669

[45] Mar. 6, 1979

[54] CONTINUOUSLY OPERATING CENTRIFUGAL SEPARATORS

[75] Inventor: Gérard Burlet, Villeurbanne, France

[73] Assignee: Robatel S.L.P.I., Genas, France

[21] Appl. No.: 864,905

[22] Filed: Dec. 27, 1977

[30] Foreign Application Priority Data

Oct. 20, 1977 [FR] France ..... 77 32338

[51] Int. Cl.[2] ..... B04B 1/20

[52] U.S. Cl. ..... 233/7

[58] Field of Search ..... 233/7, 1 R, 14 R, 14 A, 233/1 D

[56] References Cited

U.S. PATENT DOCUMENTS

| | | | |
|---|---|---|---|
| 3,368,747 | 2/1968 | Lavanchy et al. | 233/7 |
| 3,568,919 | 3/1971 | Nielsen | 233/7 |
| 3,854,658 | 12/1974 | Probstmeyer | 233/7 |

*Primary Examiner*—George H. Krizmanich
*Attorney, Agent, or Firm*—Dowell and Dowell

[57] ABSTRACT

In a continuously operating centrifugal separator of the kind comprising a bowl which rotates at a high speed and a conveyor screw which rotates at a slightly different speed within the bowl and co-axially thereto in such manner as to move the solid phase separated against the inner wall of the bowl, towards solid discharge ports provided adjacent the smaller base of a frusto-conical end portion of the bowl, at a lower radial distance from the axis of the machine than liquid discharge ports located adjacent the periphery of the other end of the bowl and which determine the formation within the bowl of a rotating liquid mass or pond having a cylindrical inner surface, the liquid product to be treated being fed axially into an inner chamber of the hollow hub of the conveyor screw from which it flows toward the annular space provided between the said hub and the inner periphery of the bowl through generally radial feed channels located about midway of the ends of the bowl, these feed channels open substantially tangentially and forwardly with respect to the rotation of the conveyor screw, with their outlets close to, but still spaced from the inner surface of the rotating liquid pond. In a preferred embodiment these outlets are formed of right angle elbows fixed to the periphery of the hub and they are directed parallel to the adjacent turns of the conveyor.

3 Claims, 2 Drawing Figures

CONTINUOUSLY OPERATING CENTRIFUGAL SEPARATORS

The present invention relates to continuously operating centrifugal separators of the kind comprising a drum or bowl rotated at a high speed and a conveyor screw which rotates at a slightly different speed within the bowl and co-axially thereto in such manner as to move the solid phase separated against the inner wall of the bowl towards solid discharge ports provided adjacent the smaller base of a frusto-conical end portion of the bowl, at a lesser radial distance from the axis of the machine than the liquid discharge ports which are located adjacent the periphery of the other end of the bowl.

In the hitherto known centrifugal machines of this kind, the liquid product to be treated is generally fed through an axial tube which opens within the hollow hub of the conveyor screw, this hub being formed with radial feed channels through which the product flows toward the annular space provided between the said hub and the inner periphery of the bowl. These feed channels are generally situated about midway of the ends of the bowl in order that the liquid and the solid phases may have to move along a substantial portion of the length of the bowl before reaching their respective discharge ports. Such an arrangement is generally usually called a central feed.

The disadvantage of this method is that since the speed difference between the conveyor screw and the bowl is relatively small, the substantially liquid product issuing from the radial feed channels strikes radially and with a high impact force the cylindrical mass or pond of liquid which rotates with the bowl. This has for its result the formation of strong eddies which entrain the solid particles normally urged against the wall of the bowl, thus reducing in a considerable manner the separating effect of centrifugal force in the central zone of the bowl.

It has been proposed to dispose in front of the outlet of a radial feed channel a flat angled baffle directing the product towards the solid discharge end of the bowl. But the jet thus deflected strikes the adjacent turn of the screw conveyor, which of course, creates strong eddies within the annular liquid mass in the central zone of the bowl. Moreover the baffle did not cover the full cross-sectional area of the channel outlet and therefore a portion of the stream issuing from the channel could escape the action of the baffle and strike radially the liquid mass.

In accordance with the present invention these inconveniences are avoided by providing the feed channels such that they open substantially tangentially with respect to the common axis of the bowl and of the conveyor screw, their outlets being close to, but still spaced from the cylindrical inner surface of the rotating liquid mass or pond.

With such an arrangement the product issuing from the feed channels strikes the rotating liquid mass with a practically negligible radial velocity component, whereby any substantial formation of eddies is avoided in the central zone of the bowl where therefore centrifugal separation may take place under favourable conditions.

It is besides known that in centrifugal separators of the kind in question the feed channels are very generally of quite large cross section relatively to the flow rate of the product supplied to the machine, this having for its object to avoid any risk of obstruction by solid particles. It results therefrom that under the effect of the tangential acceleration to which the product is submitted when it passes radially through the channels, this product flows in the form of a stream strongly applied against the portion of the wall of each channel which is situated at the rear with respect to the direction of rotation. To obtain therefore that the flow may remain regular against the said rear portion up to the outlet of the channels, this outlet should be directed forwardly.

In a preferred embodiment the outlet of each feed channel is directed parallel to the adjacent turns of the conveyor screw, i.e. at a small angle to a plane transverse to the machine axis. This relatively small deviation from the theoritical transverse direction has no noticeable influence on the impact of the product against the rotating liquid mass and it avoids that the jets issuing from the channels may strike the screw turns.

In order to realize the feed channels according to the invention without having to provide curved passages in the thickness of the hub of the screw conveyor, the said hub may be bored radially and each bore may receive an outer elbow or nozzle bent at right angles.

Figure 1:
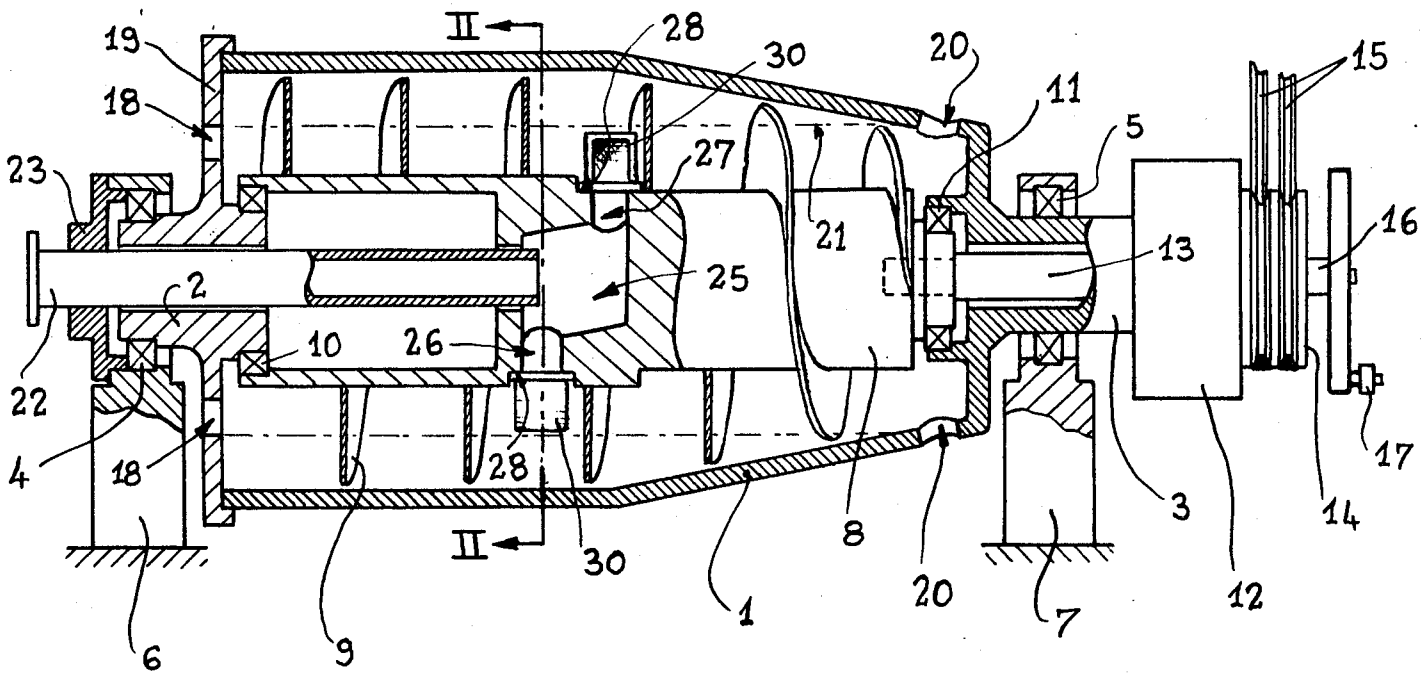
FIG. 1 is a general longitudinal section of a centrifugal separator according to the invention.

The continuously operating centrifugal separator illustrated in FIG. 1 comprises in the conventional manner a cylindro-conical drum or bowl 1 the ends of which are formed with tubular trunnions 2 and 3 rotatably mounted by means of bearings 4, 5 carried by supports 6, 7. The hub 8 of a conveyor screw 9 is disposed co-axially within bowl 1 where it is rotatably supported by bearings 10 and 11. Screw 9 is so formed that the outer edge of its turns are close to the inner periphery of the bowl, as shown. The machine is driven by a gear box 12 of the cycloidal type, the outer casing of which is fixed on an extension of trunnion 3, its output shaft 13 extending through the latter to be connected with hub 8 in any appropriate manner not shown. The input member of gear box 12 is illustrated as a double pulley 14 driven through belts 15 by an electric motor, not shown. There is further provided a reaction member in the form of a shaft 16 on which is keyed a crank 17 maintained in position by any suitable means.

The inner mechanism of gear box 12 is so arranged that bowl 1 and screw 9 are rotated in the same direction, but at slightly different speeds. The bowl may for instance rotate somewhat more rapidly than the screw.

Bowl 1 has in the conventional manner two rows of outlet ports, namely a first one 18 in the end wall 19 of its cylindrical portion and a second one 20 in its peripheral wall close to the smaller base of its frusto-conical portion. The first one is provided for discharge of the liquid phase and it thus determines the radius of the cylindrical surface 21 of the liquid mass within bowl 1 when the latter rotates at high speed. The second row is for the discharge of the solid phase and it is situated inwardly of the aforesaid cylindrical surface 21. The machine is of course surrounded by an appropriate casing in which the liquid phase and the solid phase issuing from the outlet ports are separately collected.

The product of suspension to be treated is fed through an axial tube 22 carried by a flange 23 secured to the outer side of support 6. Tube 22 extends through trunnion 2 and into hub 8 which is provided as a hollow body, and it opens in a chamber 25. The peripheral wall of this chamber is formed with two radially directed feed channels 26 and 27 diametrically opposed to each other, these channels opening on the periphery of hub 8 in a zone situated substantially midway of the ends of bowl 1.

As hitherto described, the machine is of quite conventional construction.

Figure 2:
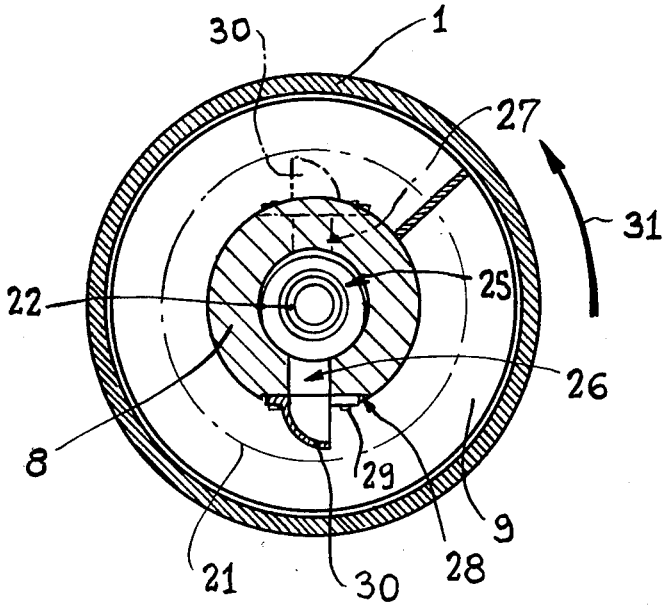
FIG. 2 is a transverse section thereof taken along line II—II of FIG. 1.

In accordance with the present invention, in order to avoid that the product issuing from channels 26 and 27 strikes the liquid surface 21 with a considerable radial impact velocity component, there has been provided around the opening of each of these channels a flat annular surface 28 (see FIG. 2) onto which a deflecting elbow 30 corresponding to an angle of substantially 90° is secured by means of screws 29, the outlet of this elbow being directed forwardly with respect to the common direction of rotation of bowl 1 and of screw 3 (see arrow 31). It should be noted that considered in the radial direction, elbows 30 terminate short of the liquid surface 21.

With such an arrangement the substantially liquid product issuing from channels 26 and 27 is deviated tangentially and forwardly by elbows 30. Moreover, since the outermost point of the outlet opening of these elbows is situated at a very small distance from surface 21, the product issuing from the elbows comes into contact with this surface with a quite negligible radial velocity component, which avoids the formation of eddies and therefore does not undesirably influence the separating action in the central zone of the bowl. Even if the flow rate of the product is quite small with respect to the cross-section of channels 26, 27 and of elbows 30, the liquid stream is applied by tangential acceleration against the rear wall of the channels and by centrifugal force against the concave or outermost portion of elbows 30, and therefore it flows in a quite uniform manner without any discontinuity.

It is important to remark:

that elbows 30 cover the full cross-sectional area of the outlets of channels 26 and 27 and that therefore however great may by the flow rate of the substantially liquid product issuing from the latter, the corresponding stream is wholly deviated;

that the outermost point of these elbows, that is the most distant from the axis of the machine, is still slightly spaced from the liquid surface 21 and that consequently these elbows have no direct influence on the cylindrical annular liquid mass which rotates within the bowl.

It is obvious that hub 8 could be formed with any number of outlet channels such as 26 and 27. It could also be of advantage in some cases to cause elbows 30 to comprise a short rectilinear extension in order to be sure that the product is safely deviated in the form of a tangentially directed jet. It may further be sometimes convenient to impart to the outlet of the elbows 30 a slight inclination with respect to a transverse plane, in order that the axis of their outlet may be substantially parallel to the adjacent portions of the screw turns, so as to be sure that the jet issuing from the said outlet does not strike one of the adjacent turns.

I claim:

1. A continuously operating centrifugal separator for separating solids from a suspension in liquids comprising:

a hollow bowl rotatable in a predetermined direction about a longitudinal axis, said bowl including a peripheral wall and including a first end and a second end, and the bowl having solid discharge ports at said first end and liquid discharge ports at said second end, said liquid discharge ports being situated at a greater radial distance from said longitudinal axis than said solid discharge ports thereby to form within said bowl under the action of centrifugal force an annular liquid mass having an inner substantially cylindrical liquid surface;

a conveyor screw co-axially disposed within said bowl and rotatable in said predetermined direction, said conveyor screw including a hub and helical screw turns extending radially from said hub close to the peripheral wall of said bowl to engage solids separated by centrifugal force against said wall, said hub having an inner chamber operative to continuously receive said suspension to be separated and the hub having feed channels each extending outwardly from said chamber and each having a suspension discharge end located close to but short of said liquid surface and each discharge end having an opening directed to discharge the suspension adjacent to said liquid surface and substantially tangentially in said predetermined direction of rotation;

a suspension feed tube extending axially through said hub and opening into the chamber thereof;

and means to rotate said bowl and said conveyor screw in said predetermined common direction, but at different speeds selected to cause the turns of said conveyor screw to move separated solids towards said solid discharge ports in said first end.

2. In a centrifugal separator as claimed in claim 1, the discharge end of each of said feed channels opening along an axis substantially parallel to the adjacent turns of said conveyor screw.

3. In a centrifugal separator as claimed in claim 1, each of said feed channels including a substantially radial passage formed in said hub and extending from said chamber and including a tubular elbow having an inlet and an outlet at substantially 90° from each other, said elbow being mounted on said hub with said inlet coupled co-axially to said radial passage to form an extension of said passage and with said outlet opening in said predetermined direction.

* * * * *